US006867760B2

(12) United States Patent
Yanagi et al.

(10) Patent No.: US 6,867,760 B2
(45) Date of Patent: Mar. 15, 2005

(54) DISPLAY DEVICE AND DISPLAY METHOD

(75) Inventors: Toshihiro Yanagi, Nara (JP); Hideki Morii, Naga-gun (JP); Hidekazu Miyata, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 137 days.

(21) Appl. No.: 10/037,804

(22) Filed: Dec. 26, 2001

(65) Prior Publication Data

US 2002/0057245 A1 May 16, 2002

Related U.S. Application Data

(62) Division of application No. 09/275,063, filed on Mar. 23, 1999.

(30) Foreign Application Priority Data

Mar. 27, 1998 (JP) ..... 10-81994

(51) Int. Cl.[7] ..... G09G 3/36
(52) U.S. Cl. ..... 345/99; 345/94
(58) Field of Search ..... 345/92, 94, 99, 345/204, 208

(56) References Cited

U.S. PATENT DOCUMENTS 4,955,697 A 9/1990 Tsukada et al.
5,408,226 A 4/1995 Kwon
5,587,722 A * 12/1996 Suzuki et al. ..... 345/94
5,714,968 A 2/1998 Ikeda
5,754,155 A 5/1998 Kubota et al.
5,774,099 A 6/1998 Iwasaki et al.
5,798,744 A 8/1998 Tanaka et al.
5,844,534 A 12/1998 Okumura et al.
6,191,769 B1 * 2/2001 Fujiwara et al. ..... 345/99
6,225,992 B1 5/2001 Hsu et al.
2001/0033266 A1 * 10/2001 Lee ..... 345/94

FOREIGN PATENT DOCUMENTS

JP 63-198022 8/1988
JP 03294822 A 12/1991
JP 04-265991 9/1992
JP 7-120720 5/1995

* cited by examiner

*Primary Examiner*—Bipin Shalwala
*Assistant Examiner*—Ricardo Osorio
(74) *Attorney, Agent, or Firm*—Nixon & Vanderhye P.C.

(57) ABSTRACT

In the display device and the display method of the present invention, a scanning signal line driving circuit controls falls of a scanning signal line, so as to make level shifts occurring to pixel potentials substantially uniform throughout display plane, the level shifts being caused by parasitic capacitances which parasitically exist in scanning signal lines. Fall waveforms of the scanning signal change at a change rate Sx which is a change quantity per unit time, and by desirably setting the change rate Sx, a change rate Sx1 in the vicinity of an input-side end of the scanning signal line and a change rate SxN in the vicinity of the other end thereof are substantially equal to each other, not being influenced by signal delay transmission characteristic which the scanning signal line possesses, like scanning signal line waveforms Vg(1, j) and Vg(N, j).

16 Claims, 12 Drawing Sheets

DISPLAY DEVICE AND DISPLAY METHOD

This application is a divisional of U.S. application Ser. No. 09/275,063, filed Mar. 23, 1999, now allowed, the teachings of which are incorporated herein by reference.

FIELD OF THE INVENTION

The present invention relates to a display device such as a matrix-type liquid crystal display (LCD) device and a display method thereof, and particularly relates to a display device such as an LCD device in which each display pixel is equipped with, for example, a thin film transistor as a switching element, and a display method thereof.

BACKGROUND OF THE INVENTION

LCD devices are widely used as display devices for use in TVs, graphic displays, and the like. Among these, attracting considerable attention are LCD devices in which each display pixel is equipped with a thin film transistor (hereinafter referred to as TFT) as a switching element, since such LCD devices produce display images which undergo no crosstalk between adjacent display pixels even in the case where display pixels therein increase in number.

Such an LCD device includes as main components an LCD panel 1 and a driving circuit section as shown in FIG. 9, and the LCD panel is formed by sealing liquid crystal composition between a pair of electrode substrates and applying deflecting plates onto outer surfaces of the electrode substrates.

A TFT array substrate which is one of the electrode substrates is formed by laying a plurality of signal lines S(1), S(2), . . . S(i), . . . S(N) and a plurality of scanning signal lines G(1), G(2), . . . G(j), . . . G(M) in a matrix form on a transparent insulating substrate 100 made of glass, for example. At each intersection of the signal lines and the scanning signal lines, a switching element 102 composed of a TFT which is connected with a pixel electrode 103 is formed, and an alignment film is provided so as to cover almost all of them. Thus, the TFT array substrate is formed.

On the other hand, a counter substrate which is the other electrode substrate is formed by laminating a counter electrode 101 and an alignment film all over a transparent insulating substrate made of, for example, glass, as the TFT array substrate. The driving circuit section is composed of a scanning signal line driving circuit 300, a signal line driving circuit 200, and a counter electrode driving circuit COM, which are connected with the scanning lines, the signal lines, and the counter electrode of the LCD panel thus formed, respectively. A control circuit 600 is a circuit for controlling both the signal line driving circuit 200 and the scanning signal line driving circuit 300.

The scanning signal line driving circuit (gate driver) 300 is composed of, for example, a shift register section 3*a* composed of M flip-flops cascaded, and selection switches 3*b* which are opened/closed in accordance with outputs of the flip-flops sent thereto, respectively, as shown in FIG. 10.

An input terminal VD1 out of two input terminals of each selection switch 3*b* is supplied with a gate-on voltage Vgh which is enough to cause the switching element 102 (see FIG. 9) to attain an ON state, while the other input terminal VD2 thereof is supplied with a gate-off voltage Vgl which is enough to cause the switching element 102 to attain an OFF state. Therefore, gate start signals (GSP) are sequentially transferred through the flip-flops in response to a clock signal (GCK) and are sequentially outputted to the selection switches 3*b*. In response to this, each selection switch 3*b* selects the voltage Vgh for turning on the TFT and outputs it to the scanning signal line 105 during one scanning period (TH), and thereafter outputs the voltage Vgl for turning off the TFT to the scanning signal line 105. With this operation, image signals outputted from the signal line driving circuit 200 to the respective signal lines 104 (see FIG. 9) can be written in respective corresponding pixels.

FIG. 11 illustrates an equivalent circuit of a one display pixel P(i, j) in which a pixel capacitor Clc and a supplementary capacitor Cs are connected in parallel to a counter potential VCOM of the counter electrode driving circuit COM. In the figure, Cgd represents a parasitic capacitance between a gate and a drain.

FIG. 12 illustrates driving waveforms of a conventional LCD device. In FIG. 12, Vg is a waveform of a signal for one scanning signal line, Vs is a waveform of a signal for one signal line, and Vd is a drain waveform.

Here, the following description will explain a conventional driving method, while referring to FIGS. 9, 11, and 12. Incidentally, it is widely known that liquid crystal requires alternating current drive so as to avoid occurrence of burn-in residual images and deterioration of displayed images, and the conventional driving method described below is explained by taking as an example a frame inversion drive which is a sort of the alternating current drive.

When a scanning voltage Vgh is applied from the scanning signal line driving circuit 300 to a gate electrode g(i, j) (see FIG. 9) of a TFT of one display pixel P(i, j) during a first field (TF1) as shown in FIG. 12, the TFT attains an ON state, and an image signal voltage Vsp from the signal line driving circuit 200 is applied to a pixel electrode through a source electrode and a drain electrode of the TFT. Until a scanning voltage Vgh is applied during the next field (TF2), the pixel electrode maintains a pixel potential Vdp as shown in FIG. 12. Since the counter electrode has a potential set to a predetermined counter potential VCOM by the counter electrode driving circuit COM, the liquid crystal composition held between the pixel electrode and the counter electrode responds in accordance with a potential difference between the pixel potential Vdp and the counter potential VCOM, whereby image display is carried out.

Likewise, when a scanning voltage Vgh is applied to a TFT gate electrode g(i, j) of one display pixel P(i, j) during the second field (TF2) from the scanning signal line driving circuit 300 as shown in FIG. 12, the TFT attains an ON state and an image signal voltage Vsn from the signal line driving circuit 200 is written in the pixel electrode. The pixel electrode maintains a pixel potential Vdn, and the liquid crystal composition responds in accordance with a potential difference between the pixel potential Vdn and the counter potential VCOM, whereby image display is carried out while liquid crystal alternating current drive is realized.

Since a parasitic capacitance Cgd is unavoidably formed between the gate and the drain of the TFT out of structural necessity as shown in FIG. 11, a level shift ΔVd caused by the parasitic capacitance Cgd occurs to the pixel potential Vd at a fall of the scanning voltage Vgh, as shown in FIG. 12. Let a non-scanning voltage (a voltage when the TFT is in the OFF state) of the scanning signal be Vgl, and the level shift Δvd which thus occurs to the pixel potential Vd, caused by the parasitic capacitance Cgd which is unavoidably formed in the TFT, is expressed as:

$$\Delta Vd = Cgd \cdot (Vgh - Vgl)/(Clc + Cs + Cgd)$$

Since the level shift causes a problem such as flickering of an image and deterioration of display, this is not favorable at all to LCD devices, of which higher definition and higher performance are required.

Therefore, conventionally has been proposed such a measure that the counter potential VCOM of the counter electrode is preliminarily biased so that the level shift ΔVd caused by the parasitic capacitance Cgd decreases.

By the foregoing conventional technique, however, it is difficult to arrange the scanning signal lines G(1), G(2), . . . G(j), . . . G(M) in such an ideal form that the scanning signal lines do not undergo signal delay transmission, and hence the scanning signal lines thus arranged results in constituting a signal delay path which undergoes signal delay to some extent.

FIG. 14 is a transmission equivalent circuit diagram in the case where signal transmission delay of one scanning signal line G(j) is focused. In FIG. 14, rg1, rg2, rg3, . . . rgN represent resistance components of wire materials forming the scanning signal lines and resistance components due to wire widths and wire lengths, mainly. cg1, cg2, cg3, . . . cgN represent various parasitic capacitances which are structurally capacitance-coupled with the scanning signal lines. The parasitic capacitances include cross capacitances which are generated at intersections of the scanning signal lines with the signal lines. Thus, the scanning signal lines constitute a signal delay transmission path of a distributed constant type.

FIG. 15 illustrates a state in which the scanning signal VG(j) supplied from the aforementioned scanning signal line driving circuit 300 to one scanning signal line dulls inside the panel due to the above-described signal delay transmission characteristic of the scanning signal line. In FIG. 15, a waveform Vg(1, j) is a waveform of the signal in the vicinity of a TFT gate electrode g(1, j) immediately after the output thereof from the scanning signal line driving circuit 300, and has substantially no dullness. In contrast, in the same figure, a waveform Vg(N, j) is a waveform of the signal in the vicinity of a TFT gate electrode g(N, j) at a farther end of the scanning signal line from the scanning signal line driving circuit 300, and has dulled due to the signal transmission delay characteristic of the scanning signal line. Due to the dullness, a shift takes place, whose change rate per unit time is indicated by SyN in the figure.

Further, the TFT is not perfectly an ON/OFF switch, but has a V-I characteristic (gate voltage-drain currency characteristic) as shown in FIG. 13. In FIG. 13, a voltage applied to the TFT gate is plotted as the axis of abscissa, while a drain voltage is plotted as the axis of ordinate. Normally the scanning pulse is composed of two voltage levels, one being a voltage level Vgh which is enough to cause the TFT to attain an ON state, while the other being a voltage level Vgl which is enough to cause the TFT to attain an OFF state. There however also exists an intermediate ON region (linear region) between a threshold level VT of the TFT and the level Vgh as shown in the figure.

Since the scanning signal therefore has a sharp fall from the level Vgh to the level vgl at a pixel having the gate electrode g(1, j), immediately behind the output side of the scanning signal line driving circuit 300 as shown in FIG. 15, the characteristic in the linear region of the TFT does not influence the scanning signal there. As a result, the level shift ΔVd(1) which occurs to the pixel potential Vd(1, j) due to the parasitic capacitance Cgd can be approximated as follows:

$$\Delta Vd(1)=Cdg\cdot(Vgh-Vgl)/(Clc+Cs+Cgd)$$

On the other hand, at the pixel having the TFT gate electrode g(N, j) located in the vicinity of the farther end of the scanning signal line, the scanning signal has a dull fall. The characteristic of the linear region of the TFT therefore reversely affects, and this results in the following: the level shift which is to occur to the pixel potential Vd due to the parasitic capacitance Cgd does not occur during the fall of the scanning signal from the level Vgh to the TFT threshold level VT since the TFT maintains the intermediate ON state due to the linear state, whereas a level shift ΔVd(N) which is to occur to the pixel potential Vd(N, j) due to the parasitic capacitance Cgd occurs in a region in which the scanning signal further falls from the vicinity of the threshold level VT to the level Vgl. Therefore, the level shift ΔVd(N) becomes as follows:

$$\Delta Vd(N)<Cgd\cdot(Vgh-Vgl)/(Clc+Cs+Cgd)$$

Thus, ΔVd(1)>ΔVd(N) is satisfied.

As described above, the level shifts ΔVd occurring to the pixel potentials Vd due to the parasitic capacitances Cgd inside the panel is not uniform throughout the display plane, and it becomes more hardly negligible as the LCD device has a larger screen and becomes higher-definition. Accordingly the conventional scheme of biasing the counter voltage becomes incapable of absorbing differences in the level shifts throughout the display plane, thereby being incapable of conducting optimal alternating current drive with respect to each pixel. Consequently defects such as flickering and burn-in residual images due to DC component application are induced (see the Japanese Publication for Laid-Open Patent Application No. 120720/1995 (Tokukaihei 7-120720, date of publication: May 12, 1995)).

SUMMARY OF THE INVENTION

The present invention is made in light of the aforementioned problems of the prior art, and the object of the present invention is to provide a display device which is capable of sufficiently suppressing occurrence of flickering and the like which ensue to fluctuations of pixel potentials caused by parasitic capacitances, and which is high-definition and high-performance.

To achieve the foregoing object, a display device of the present invention comprises (1) a plurality of pixel electrodes, (2) image signal lines for supplying data signals to the pixel electrodes, (3) a plurality of scanning signal lines provided so as to intersect the image signal lines, and (4) a driving circuit for outputting a scanning signal to actuate the scanning signal lines, as well as (5) TFTs each having a gate, a source, and a drain which are connected with one scanning signal line, one image signal line, and one image electrode, respectively, the TFTs being provided at the intersections, respectively, and the display device is arranged so that the driving circuit controls falls of the scanning signal.

With the foregoing arrangement, the scanning signal is outputted to the scanning signal lines by the driving circuit, and in this outputting operation, the falls of the scanning signal are controlled by the driving circuit.

Generally, parasitic capacitances are unavoidably formed between the gate and the drain of the thin film transistor due to the structure. In the case where the scanning signal abruptly falls as in the conventional cases, the thin film transistor immediately attains an OFF state, and upon this, a potential of a pixel electrode (hereinafter referred to as pixel potential) lowers by a quantity corresponding to a fall quantity of the scanning signal (a scanning voltage minus a non-scanning voltage) due to the parasitic capacitance, whereby a significant level shift occurs to the pixel potential. Such significant level shift occurring to the pixel potential leads to flickering of a displayed image, deterioration of display, and the like.

According to the foregoing display device, however, the falls of the scanning signal are controlled, and hence it is possible to control the scanning signal so that it does not abruptly fall. This ensures that the level shifts of the pixel potentials caused by the parasitic capacitances are reduced.

Further, wires laid on a transparent insulating substrate made of, for example, glass are not an ideal path but constitute a signal delay path which undergoes signal delay to some extent. Therefore, the foregoing arrangement ensures that irregularities of display caused by the signal delay are cancelled, and moreover, that the level shifts caused to the pixel potentials by the parasitic capacitances are made smaller and uniform. In result, displayed images of high performance can be obtained.

For a fuller understanding of the nature and advantages of the invention, reference should be made to the ensuing detailed description taken in conjunction with the accompanying drawings.

DESCRIPTION OF THE PREFERRED EMBODIMENTS

The present invention is made on the basis of the following: in a display device such as an LCD device, an input signal which varies without being affected by signal delay transmission characteristic which parasitically occurs is inputted to a wire laid on a transparent insulating substrate made of glass or the like, and by so doing, a waveform identical to a waveform of the input signal can be obtained at any position on a wire, while influences due to signal change can be made constant throughout the wire.

The present invention is also made on the basis of the following: depending on a ON/OFF characteristic of a switching element of a TFT or the like connected with the wire, a level shift caused by a parasitic capacitance can be reduced by making the input waveform and the waveform at a certain point of the wire dull.

First Embodiment

Figure 1:
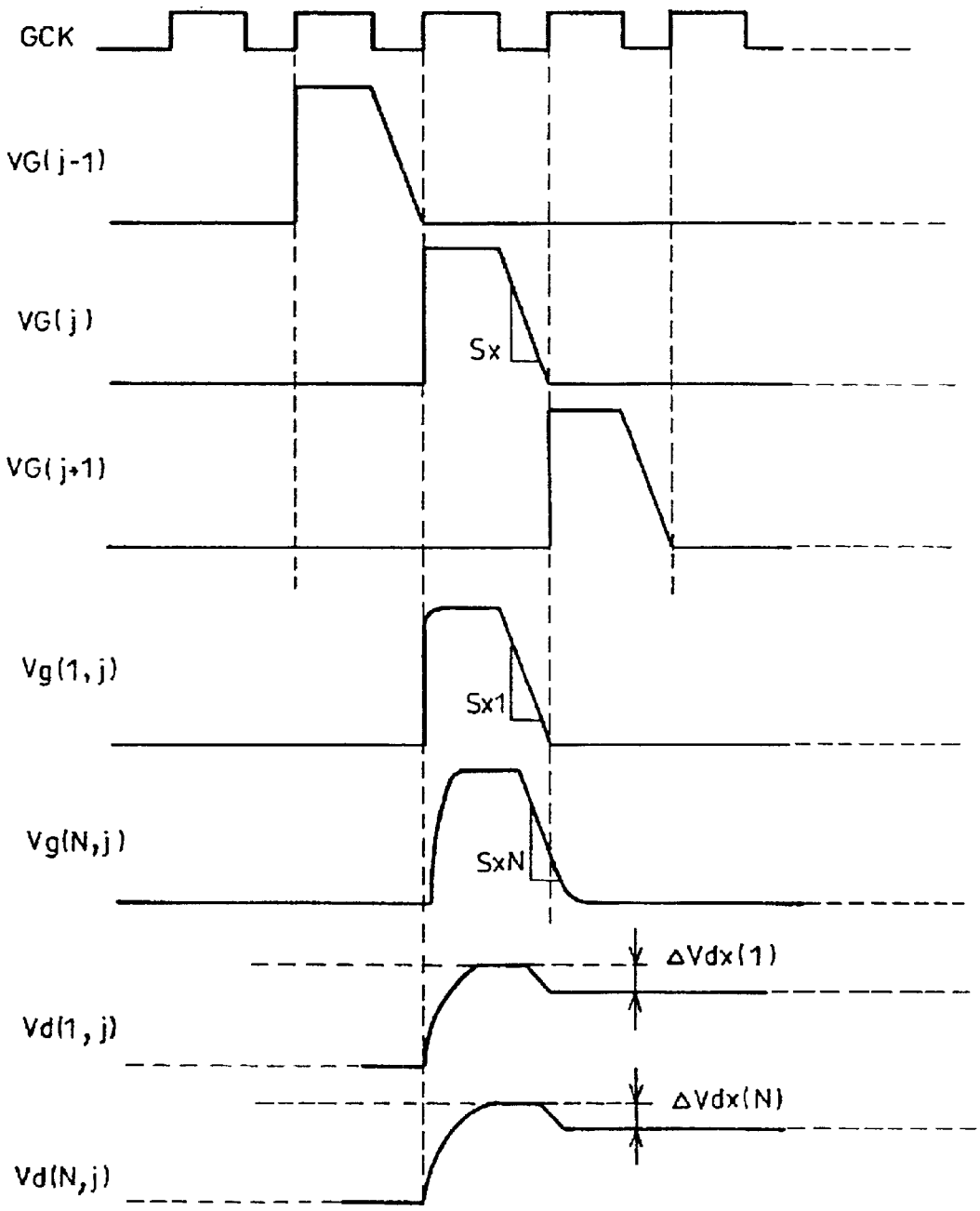
FIG. 1 is a waveform chart illustrating waveforms outputted from components of a scanning signal line driving circuit in accordance with one embodiment of the present invention.
Figure 2:
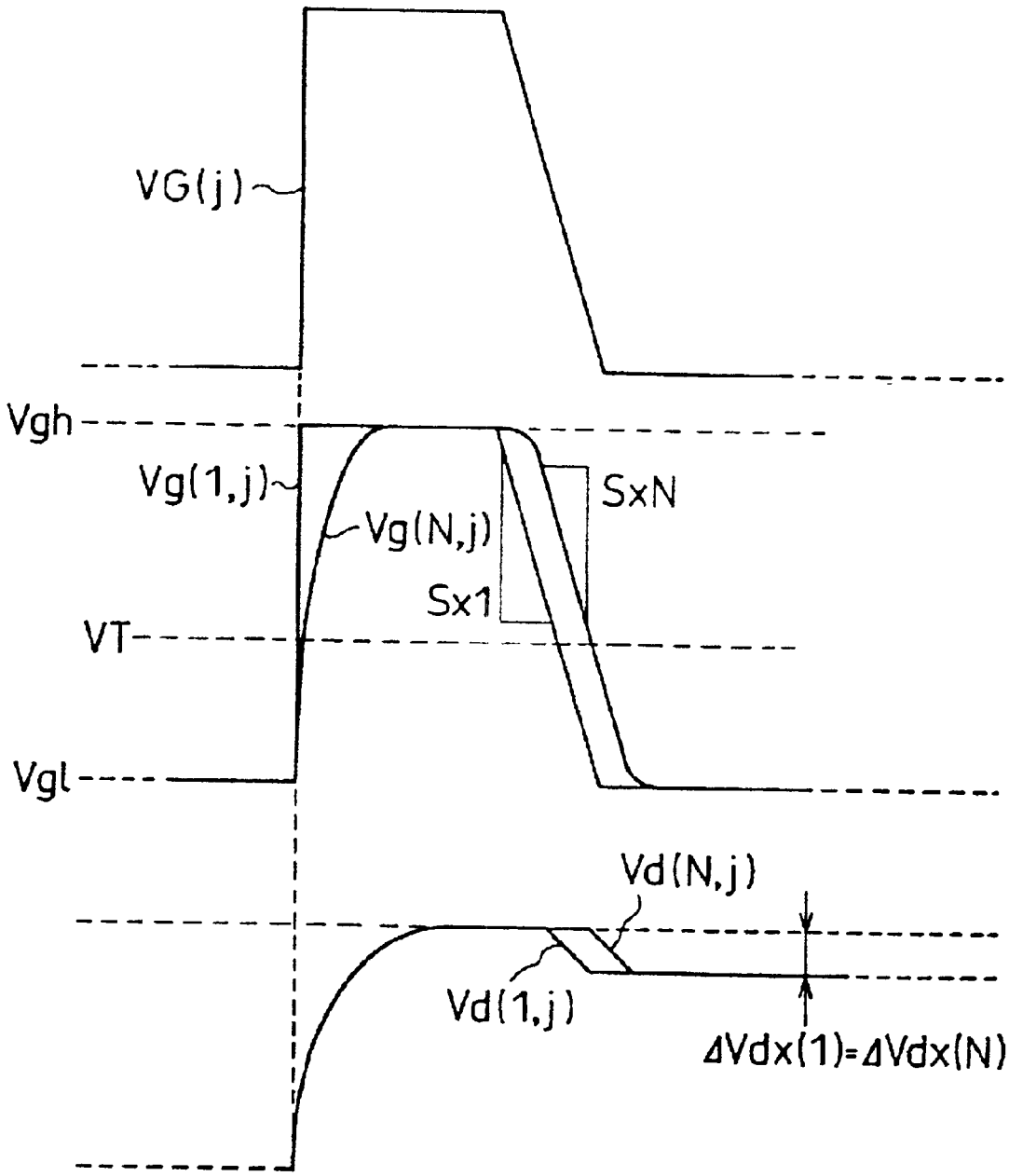
FIG. 2 is a waveform chart illustrating a scanning signal line waveform in the vicinity of an input-side end of a scanning signal line, a scanning signal line waveform in the vicinity of the other end of the scanning signal line, and respective pixel potentials.

The following description will explain a first embodiment of the present invention while referring to FIGS. 1 and 2. Note that in FIG. 1 GCK represents a clock signal.

FIGS. 1 and 2 show output waveforms VG(j−1), VG(j), and VG(j+1) of a scanning signal line driving circuit in accordance with the present embodiment, a scanning signal line waveform Vg(1, j) in the vicinity of an input-side end of a scanning signal line, a scanning signal line waveform Vg(N, j) in the vicinity of the other end of the scanning signal line, and respective pixel potentials Vd(1, j) and Vd(N, j) in the vicinity of the foregoing ends of the scanning signal line. In the output waveform VG(j) of the scanning signal line driving circuit, the fall from a scanning voltage Vgh to a non-scanning voltage Vgl is a fall at a slope (inclination) indicated by a change rate Sx, which is a change quantity per unit time, as shown in FIG. 1.

The present embodiment has a display system in which data signals are supplied to a plurality of pixel electrodes through image signal lines while the pixel electrodes are actuated by supplying a scanning signal thereto through a scanning signal line which intersects the image signal lines. In this system, fall of the scanning signal is controlled during the actuation, and control of this fall is enabled by setting the change rate Sx desirably.

Thus, by appropriately setting the change rate Sx, a change rate Sx1 of a fall waveform in the vicinity of the input-side end of the scanning signal line, and a change rate SxN of a fall waveform in the vicinity of the other end of the scanning signal line, become substantially equal, not being affected by signal delay transmission characteristic which the scanning signal line parasitically possesses, like the scanning signal line waveforms Vg(1, j) and Vg(N, j) (see FIGS. 1 and 2). This causes level shifts occurring to the pixel potentials Vd due to parasitic capacitances Cgd which parasitically exist in the scanning signal line to become substantially uniform throughout a display plane. In result, by applying a conventional scheme of biasing a counter potential VCOM so as to preliminarily reduce the level shifts ΔVd occurring to the pixel potentials Vd due to parasitic capacitances Cgd which parasitically exist in the scanning signal line, or the like, a display device in which flickering can be sufficiently reduced and which do not undergo defects such as burn-in residual images can be realized.

To make the change rates Sx1 and SxN of the fall waveforms substantially equal irrelevant to their positions on the scanning line, control of the falls may be conducted on the basis of the signal delay transmission characteristic. Control in this manner enables to make the slopes of the scanning signal falls substantially equal wherever on the scanning line, thereby making level shifts of the pixel electrodes substantially equal.

Instead of the foregoing control of falls on the basis of the signal delay transmission characteristic, slopes of falls of the scanning signal may be controlled on the basis of a gate voltage-drain currency characteristic of the TFT. In the TFT, upon application of a voltage in a range of a threshold voltage to an ON voltage to the gate thereof, a drain currency (ON resistance) of the TFT, depending on a gate voltage, linearly varies. In other words, the TFT attains, not an ON state out of the binary states, but an intermediate ON state (in which the drain currency varies in an analog form in accordance with the gate voltage).

In this case, if the falls of the scanning signal are abrupt as in the conventional cases, level-shifts of the pixel potentials caused by the parasitic capacitances occur as described above, irrelevant to the gate voltage-drain currency characteristic of the TFT. In the present embodiment, however, it is possible to control slopes of falls of the scanning signal so that the slopes are affected when the TFT is in the state of the foregoing linear variation (intermediate ON state). Since such control causes the fall of the scanning signal to become sloped while the TFT also linearly shifts from the ON state to the OFF state in accordance with the voltage-currency characteristic, each level shift of the pixel potential stemming from the parasitic capacitance is surely reduced.

It is more preferable to control the slopes of the falls of the scanning signal on the basis of both the signal delay transmission and the gate voltage-drain currency characteristic of the TFT. In this case, it is possible to make substantially equal the slopes of any falls of the scanning signals wherever on the scanning signal line. In result, the level shifts of the pixel potentials are made substantially equal to each other, while each level shift per se decreases.

Figure 13:
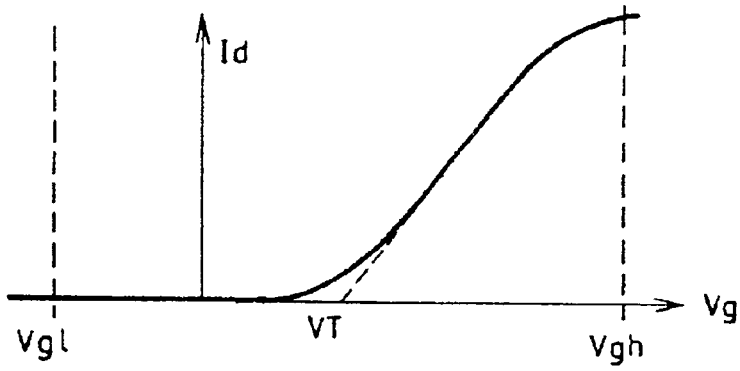
FIG. 13 is an explanatory view used in explanation of both the present invention and the prior art, which shows that a TFT is not perfectly an ON/OFF switch but has a linear gate voltage-drain currency characteristic.
Figure 14:
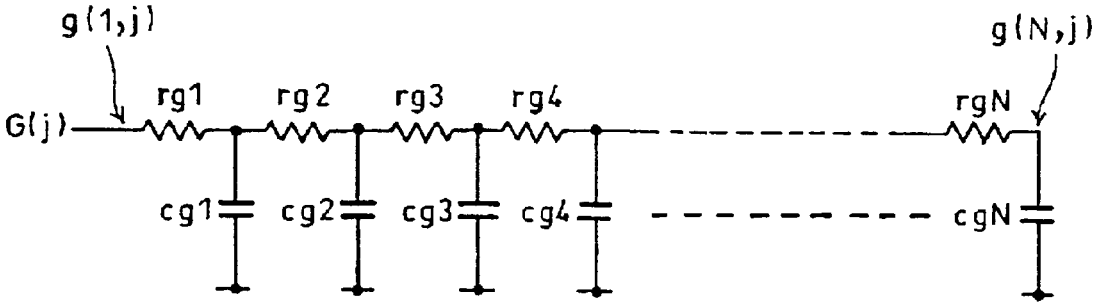
FIG. 14 is a transmission equivalent circuit diagram in the case where signal transmission delay of one scanning signal line is focused.

Furthermore, the voltage level VT shown in FIG. 2 is a threshold voltage of the TFT shown in FIG. 13, and since the TFT maintains the ON state during a time while the scanning signal falls from the scanning voltage Vgh to the threshold voltage VT, a level shift due to the parasitic capacitance Cgd hardly occurs during the foregoing time. On the other hand, there occurs a level shift due to a parasitic capacitance Cgd, influenced by a scanning signal line shift (VT−Vgl) which causes the TFT to attain the OFF state.

Since VT−Vgl<Vgh−Vgl is satisfied in the present embodiment, it is possible not only to cancel differences in the level shifts caused by parasitic capacitances throughout the display plane, but also to reduce each level shift per se caused by the parasitic capacitance Cgd.

Figure 15:
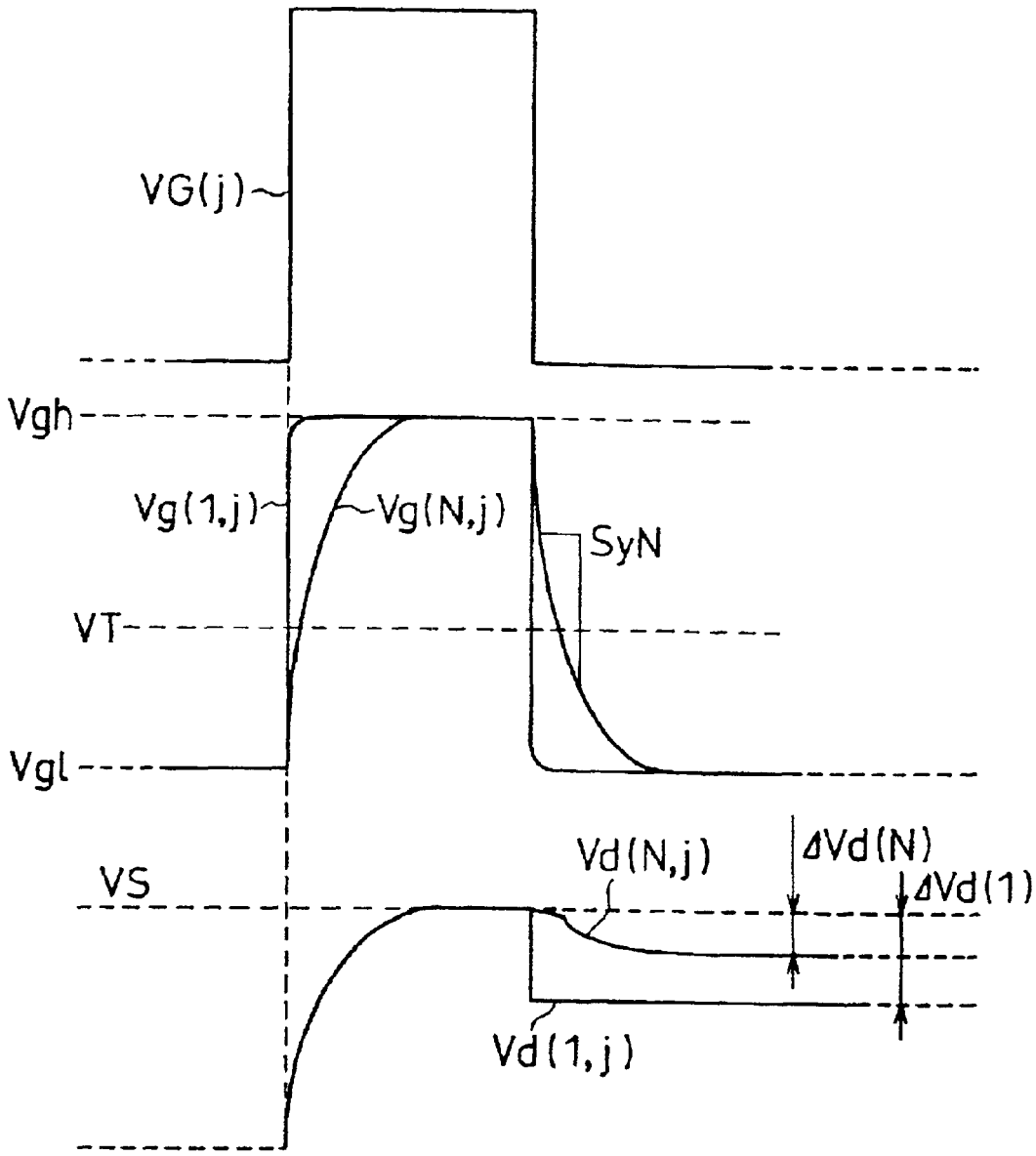
FIG. 15 is an explanatory view illustrating a state in which a scanning signal supplied to a scanning signal line from the scanning signal linen driving circuit dulls inside the panel due to the signal delay transmission characteristic of the scanning signal line.

Here, let a level shift caused by the parasitic capacitance Cgd to the pixel potential Vd of the pixel in the vicinity of an end of the scanning signal line on the side to the scanning signal line driving circuit of the prior art be ΔVd(1), while let a level shift occurring to the pixel at the other end thereof of the prior art be ΔVd(N), and further, let a level shift of the pixel potential Vd in the vicinity of an end of the scanning signal line on the side to the scanning signal line driving circuit of the present embodiment be ΔVdx(1), while let a level shift occurring to the pixel potential Vd at the other end thereof of the present embodiment be ΔVdx(N). In this case, since the change rates Sx1 and SxN of the fall waveforms are substantially equal, not being affected by the signal delay transmission characteristic which the scanning signal line parasitically possesses as described above, the level shifts occurring to the pixel potentials Vd due to the parasitic capacitances Cgd which parasitically exist become substantially uniform throughout the display plane, and satisfy the following relationship (see FIGS. 2 and 15):

$$\Delta Vdx(1)=\Delta Vdx(N)<\Delta Vd(N)<\Delta Vd(1)$$

Accordingly, by applying the conventional scheme of biasing the counter potential VCOM of the counter electrode so that the level shifts stemming from the parasitic capacitances are preliminarily reduced, it is possible to provide a display device featuring lower bias level, less flickering and display defects such as burn-in residual images, and less power consumption.

Second Embodiment

Figure 3:
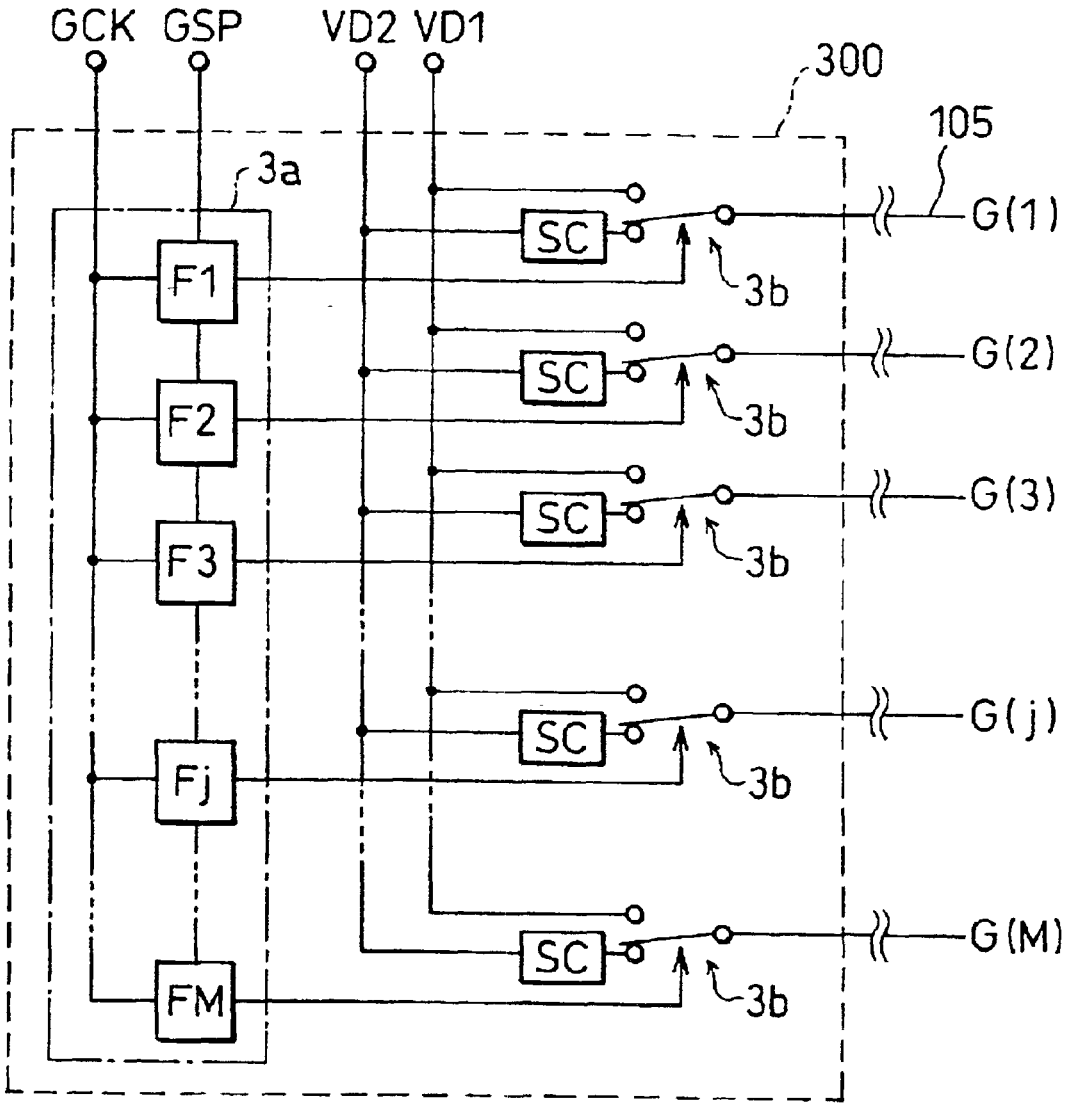
FIG. 3 is an explanatory view illustrating an arrangement of a scanning signal line driving circuit in accordance with another embodiment of the present invention.

The following description will explain a second embodiment of the present invention, while referring to FIG. 3. For conveniences' sake, the members having the same structure (function) as those in FIG. 10 will be designated by the same reference numerals.

Figure 10:
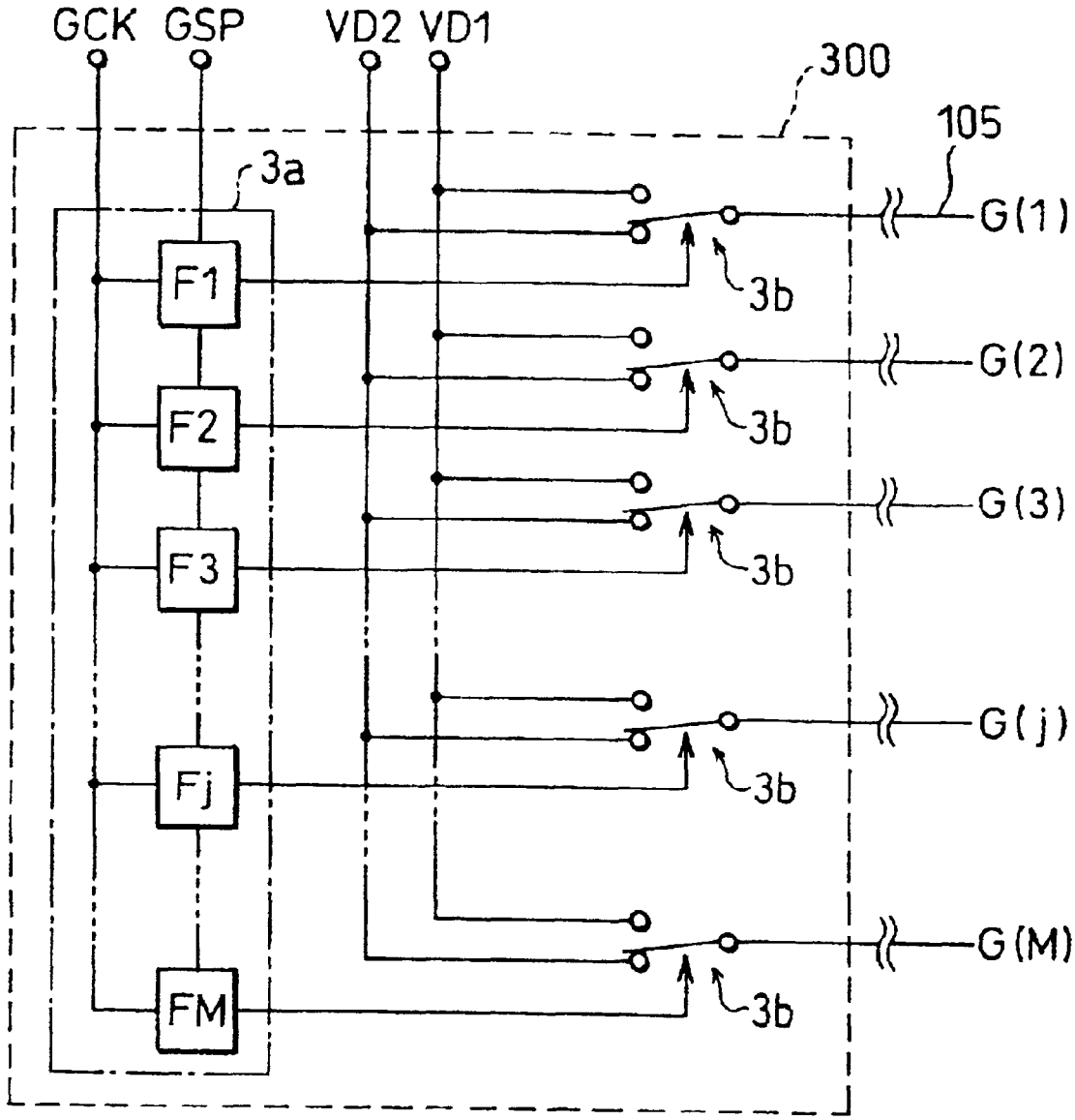
FIG. 10 is an explanatory view illustrating an arrangement of a conventional scanning signal line driving circuit.
Figure 11:
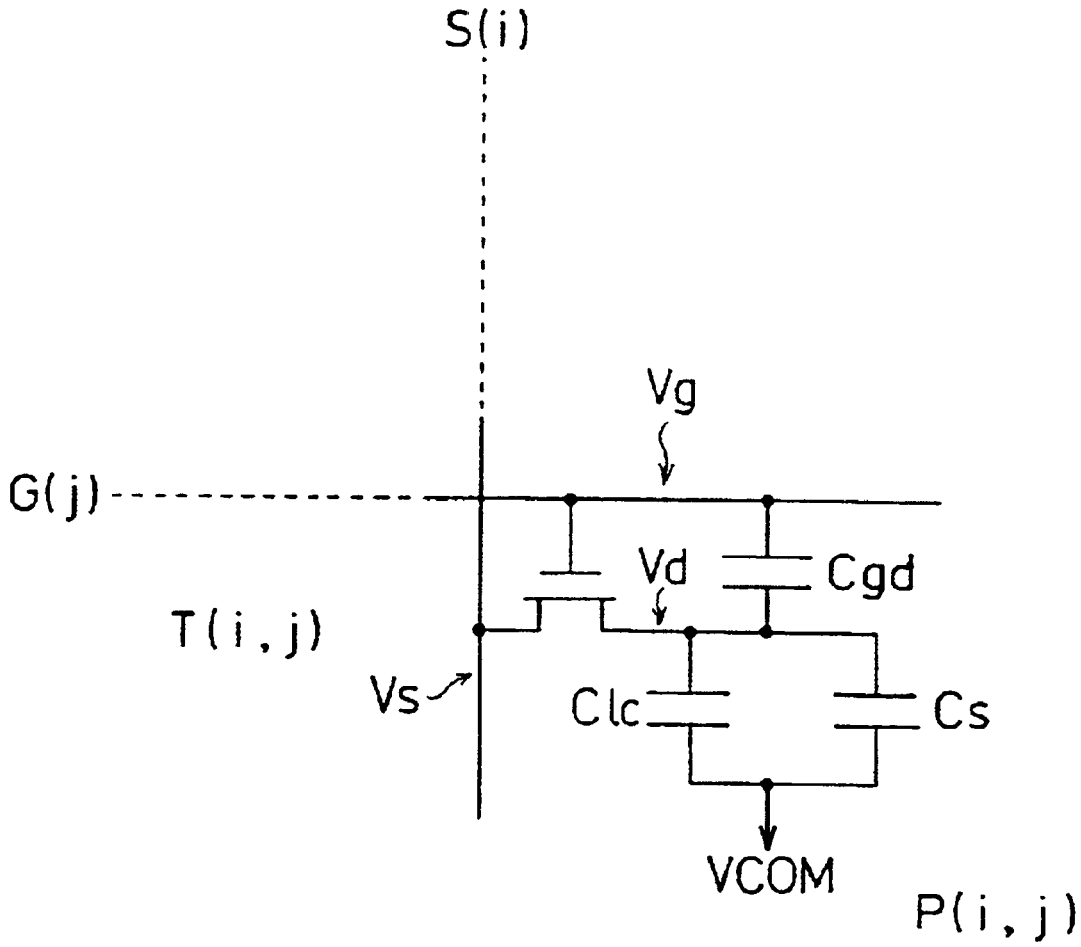
FIG. 11 is a equivalent circuit diagram of one display pixel which is arranged so that a pixel capacitor and a supplementary capacitor are connected in parallel to a counter potential of a counter electrode driving circuit.
Figure 12:
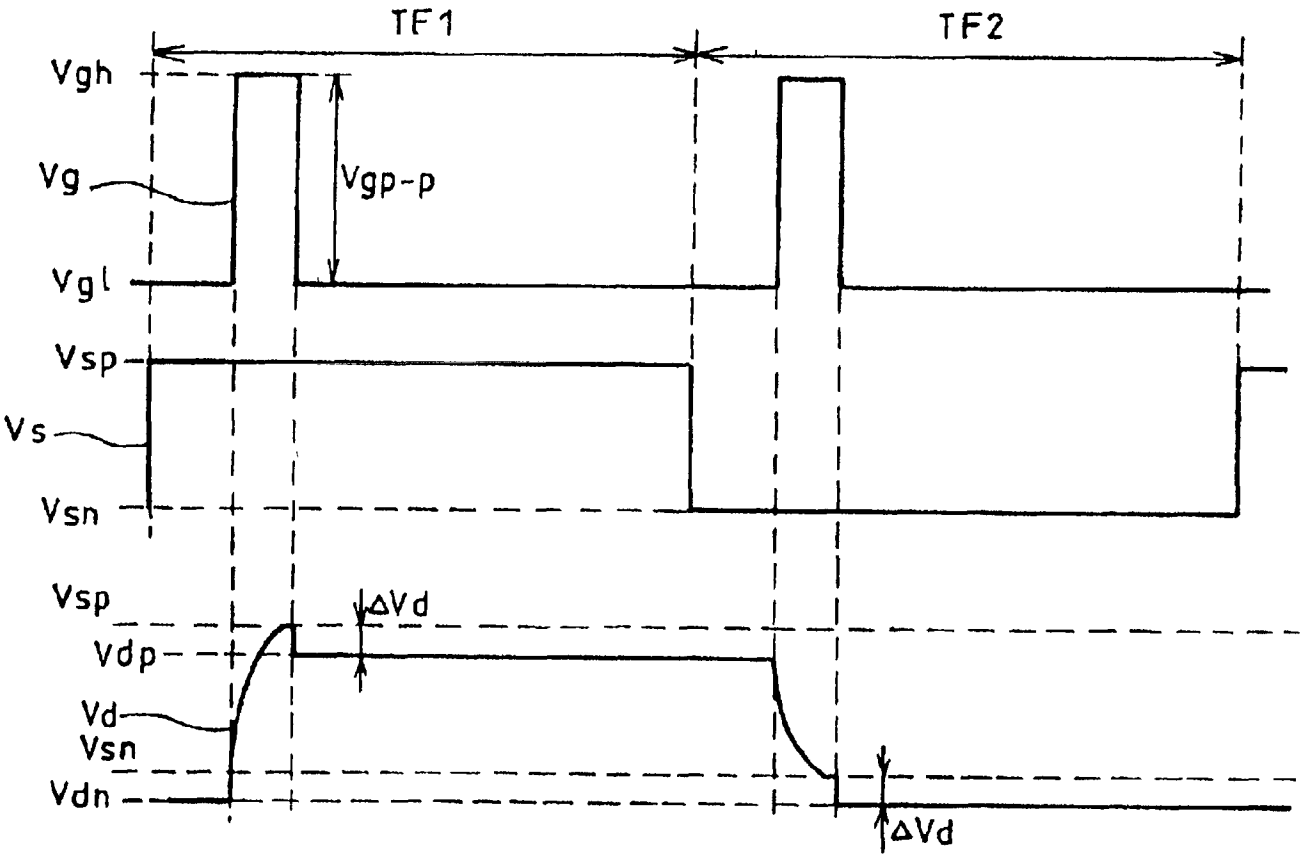
FIG. 12 is a driving waveform chart of a conventional liquid crystal display device.

In the second embodiment of the present invention, as shown in FIG. 3, as in the case of the conventional scanning signal line driving circuit shown in FIG. 10, the scanning signal line driving circuit is composed of a shift register section 3*a* composed of M flip-flops (F1, F2, . . . , Fj, . . . , FM) cascaded, and selection switches 3*b* which are opened/closed in accordance with outputs from the flip-flops, respectively. An input terminal VD1 out of two input terminals of each selection switch 3*b* is supplied with a gate-on voltage Vgh which is enough to cause the TFT to attain an ON state, while the other input terminal VD2 thereof is supplied with a gate-off voltage Vgl which is enough to cause the TFT to attain an OFF state. A common terminal of each switch 3*b* is connected with the scanning signal line 105.

Therefore, gate start signals (GSP) are sequentially transferred through the flip-flops in response to clock signals (GCK) and are sequentially outputted to the selection switches 3*b*. In response to this, during one scanning period (TH), each selection switch 3*b* selects the voltage Vgh for causing the TFT to attain the ON state and outputs it to the scanning signal line 105, and thereafter selects the voltage Vgl for causing the TFT to attain the OFF state and outputs it to the scanning signal line 105.

In the second embodiment, as shown in FIG. 3, slew-rate (slue rate) control elements SC (slope control sections) which are capable of controlling fall rates of output signals (gate-off voltages Vg1) are added to the output stage of the conventional gate driver. With this arrangement, fall slopes of the scanning signals respectively outputted to the scanning signal lines can be controlled, as in the case shown in FIGS. 1 and 2.

Each of the slew-rate control elements SC, which is provided between the selection switch 3*b* and the input terminal VD2, is equivalently an output impedance control element which controls impedance of each output of the gate driver, which increases output impedance only upon fall of the gate-off voltage outputted to the scanning signal line (the fall of the gate-off voltage is hereinafter referred to as "scanning signal line fall"), thereby to make the output waveform of the gate driver dull. This causes differences in fall speeds in the display panel, which stem from waveform dullness as transmission characteristics of the scanning signal lines, to cancel each other. In result, it is possible to suppress occurrence of the level shifts ΔV due to influence of the aforementioned parasitic capacitances Cgd, while to make the level shifts throughout display panel equal to each other.

Incidentally, the slew-rate control element SC is not particularly limited, and it may be anything provided that it is capable of varying the output impedance so as to vary the fall speed. It may be realized by using, for example, a common control technique of adjusting impedance by controlling a gate voltage of a MOS transistor element.

Further, the output impedance is increased only upon the scanning signal line fall so that only the fall waveform is dulled in the present embodiment, but according to a panel structure used, the output impedance may, not being increased only upon the scanning signal line fall, but remain at an increased level unless another display defect such as crosstalk occurs with a high impedance during a time while the gate-off voltage Vgl is outputted after the scanning signal line fall.

Third Embodiment

As to the above-described second embodiment, a case where the slew-rate control element SC for controlling the fall speed (slope) of the scanning signal is added to the conventional structure of the scanning signal line driving circuit (gate driver) is explained. In this case, however, it is necessary to additionally provide the slew-rate control element SC in the gate driver, and the conventional common inexpensive gate driver cannot be applied as it is. Therefore it is not economical.

In the third embodiment of the present invention, a conventional inexpensive common gate driver is used. This case will be explained below, with reference to FIGS. 4 and 5.

The conventional gate driver is, as explained above with reference to FIG. 10, arranged as follows: the gate-on voltage Vgh and the gate-off voltage Vgl are supplied thereto, and in response to the clock signal GCK, the gate driver outputs the scanning ON voltage Vgh to the scanning signal lines 105 sequentially, i.e., to one line during one scanning period (TH) selected, while outputs the voltage Vgl for causing the TFT to attain the OFF state to each scanning signal line 105 after the foregoing scanning period. On the other hand, in the present third embodiment, a circuitry as shown in FIG. 4 is adapted, whose output is used as the voltage Vgh of the scanning signal line driving circuit.

Figure 4:
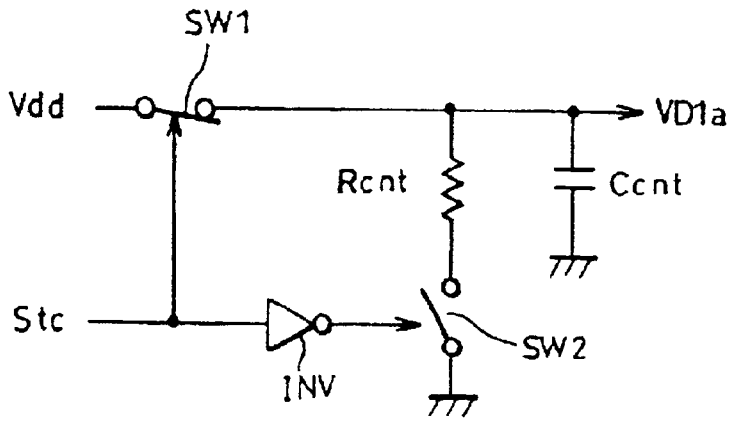
FIG. 4 is a block diagram illustrating an arrangement of a principal part of a scanning signal line driving circuit in accordance with still another embodiment of the present invention.

FIG. 4 shows a principal part of the scanning signal line driving circuit in accordance with the present embodiment, the principal part being composed of a resistor Rcnt and a capacitor Ccnt for electric charging and discharging respectively, an inverter INV for controlling the electric charging/discharging, and switches SW1 and SW2 for switching the electric charging/discharging.

Figure 5:
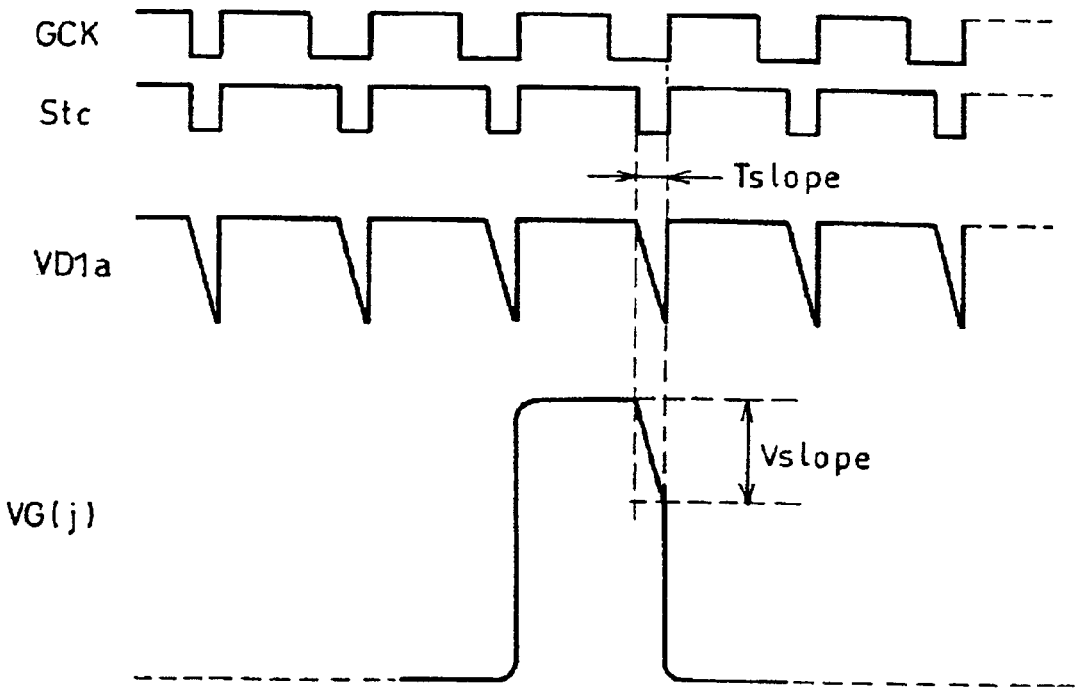
FIG. 5 is a waveform chart showing waveforms of main components in the arrangement shown in FIG. 4.

A signal voltage Vdd is applied to one terminal of the switch SW1. The signal voltage Vdd is a direct current voltage which has a voltage level same as Vgh enough to cause the TFT to attain the ON state. The other terminal of the switch SW1 is connected with one end of the resistor Rcnt, as well as with one terminal of the capacitor Ccnt. The other terminal of the resistor Rcnt is grounded via the switch SW2. Opening/closing control of the switch SW2 is carried out according to a signal Stc (see FIG. 5) which is supplied through the inverter INV. The signal Stc, generated by a control section which is not shown, synchronizes with each scanning period, and is also used in the opening/closing control of the switch SW1. The signal Stc is arranged so as to synchronize with the clock signal (GCK) as shown in FIG. 5, and it may be produced, for example, by using a mono multivibrator (not shown).

Regarding opening/closing operations of the switches SW1 and SW2, which will be described in more detail later, the switch SW1 is closed when the signal Stc is at the high level, and here the switch SW2 becomes opened since a low level voltage is applied thereto through the inverter INV. On the other hand, the switch SW1 is opened when the signal Stc is at the low level (discharge control signal), and here the switch SW2 becomes closed since a high level voltage is applied thereto through the inverter INV. In short, in the arrangement shown in FIG. 4, the switches SW1 and SW2 are high (level)-active elements.

An output signal VD1*a* produced by the foregoing circuit is sent to the input terminal VD1 of the scanning signal line driving circuit 300 shown in FIG. 10. The signal Stc is a timing signal for use in control of a gate fall (scanning signal fall) time as shown in FIG. 5, which synchronizes with each scanning period (TH).

With the foregoing arrangement, while the signal Stc is at the high level, the switch SW1 is closed while the switch SW2 is opened, and the output signal VD1*a* is outputted as a voltage of the level Vgh to the input terminal VD1 of the scanning signal line driving circuit 300. On the other hand, while the signal Stc is at the low level, the switch SW1 is opened while the switch SW2 is closed, and electric charges stored in the capacitor Ccnt are discharged through the resistor Rcnt, whereby the voltage level gradually lowers. In result, the output signal VD1*a* has a serrature-like waveform as shown in FIG. 5 (this type of serrature-like waveform with voltage-unchanging portions intermittently appearing as shown in FIG. 5 is hereinafter referred to as intermittent-serrature-like waveform, while "serrature-like waveform" is meant to broadly indicate all types of waveforms in a serrature-like form, including those with no voltage-unchanging portions).

By sending the output signal VD1*a* (see FIG. 5) produced by the circuit shown in FIG. 4 to the input terminal VD1 of the scanning signal line driving circuit 300, it is possible to easily produce a waveform in which the scanning signal line fall is sloped, like the waveform VG(j) shown in FIG. 5. A slope time of sloped fall of the waveform is adjusted by varying a low-level period of the signal Stc, and a slope quantity Vslope can be adjusted by varying a resistance of the resistor Rcnt and a capacitance of the capacitor Ccnt so that a time constant of the circuit is adjusted. Thus, they may be optimized for each display panel to be driven.

Figure 6:
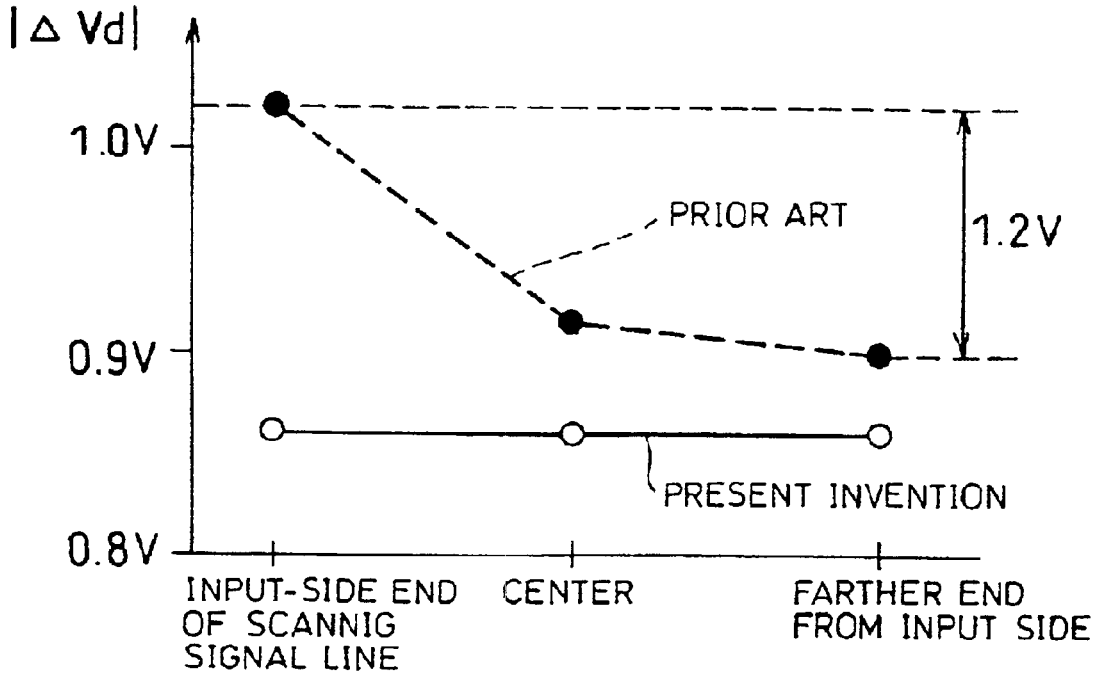
FIG. 6 is a graph showing results of comparison between characteristics of a level shift caused by a parasitic capacitance Cgd in the case where the arrangement shown in FIG. 4 is applied to a 13.3-inch diagonal XGA (resolution:1024×RGB×768) and those in the case of the prior art.

FIG. 6 shows measurement results of level shifts caused by parasitic capacitances Cgd depending on positions on the scanning signal line, in the case where the present embodiment is applied to a 13.3-inch diagonal XGA (resolution:1024RGB×768). The following is clear from FIG. 6: with application of the present embodiment, biased distribution (irregularities) of the level shifts ΔVd in the display panel were completely eliminated and degrees of the level shifts ΔVd per se lowered as well.

As shown in FIG. 5, in the output waveform VG(j), the waveform of the fall is not necessarily sloped thoroughly from the level Vgh to the level Vgl. More specifically, FIG. 6 shows that the slope of the gate fall in an ON region of the TFT (namely, a region in which the output waveform VG(j) is in a range of the voltage Vgh to the threshold voltage) has a great significance in distribution of the level shifts ΔVd throughout the display plane. In other words, in the OFF region of the TFT, the level shifts ΔVd does not depend on the speed of the gate fall. Therefore, such a slight re-shaping of the fall waveform yields a sufficient effect.

Fourth Embodiment

In the aforementioned third embodiment, the fall speed of the scanning signal line fall is controlled by (i) adjusting the slope time of the scanning signal line fall by varying a low-level period of the signal Stc, and (ii) adjusting a slope quantity Vslope by varying a resistance of the resistor Rcnt and a capacitance of the capacitor Ccnt so that a time constant of the circuit is adjusted. In the case of a larger-size display device, electric charge held by a scanning signal line varies with parasitic capacitances at intersections of scanning signal lines and signal lines as well as with a display state, and moreover, in the case where the device adapts a scheme of natural discharge, the fall speed is unstable, whereby the display device is, far from achieving the object, prone to a new defect such as display noise. The present embodiment is to solve such inconveniences. The following description will explain details of the present embodiment.

Figure 7:
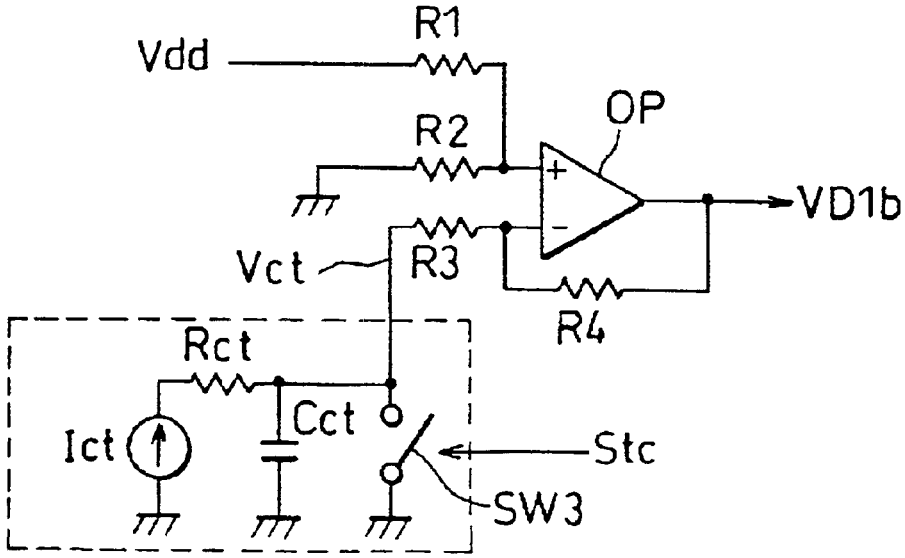
FIG. 7 is a circuit diagram illustrating an arrangement of a principal part of a scanning signal line driving circuit in accordance with still another embodiment of the present invention.
Figure 8:
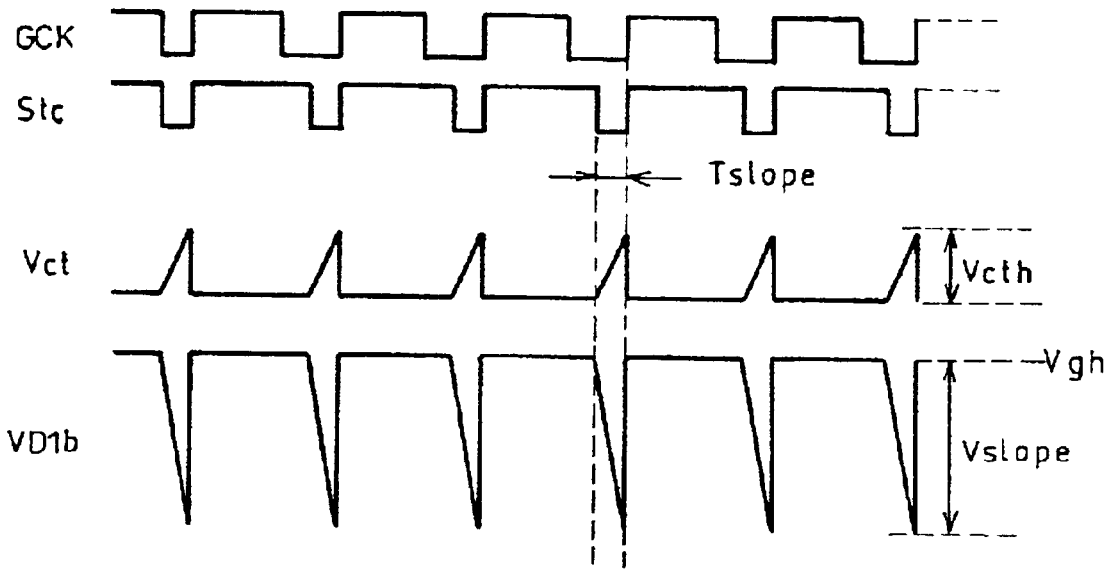
FIG. 8 is a waveform chart showing waveforms of main components in the arrangement shown in FIG. 7.
Figure 9:
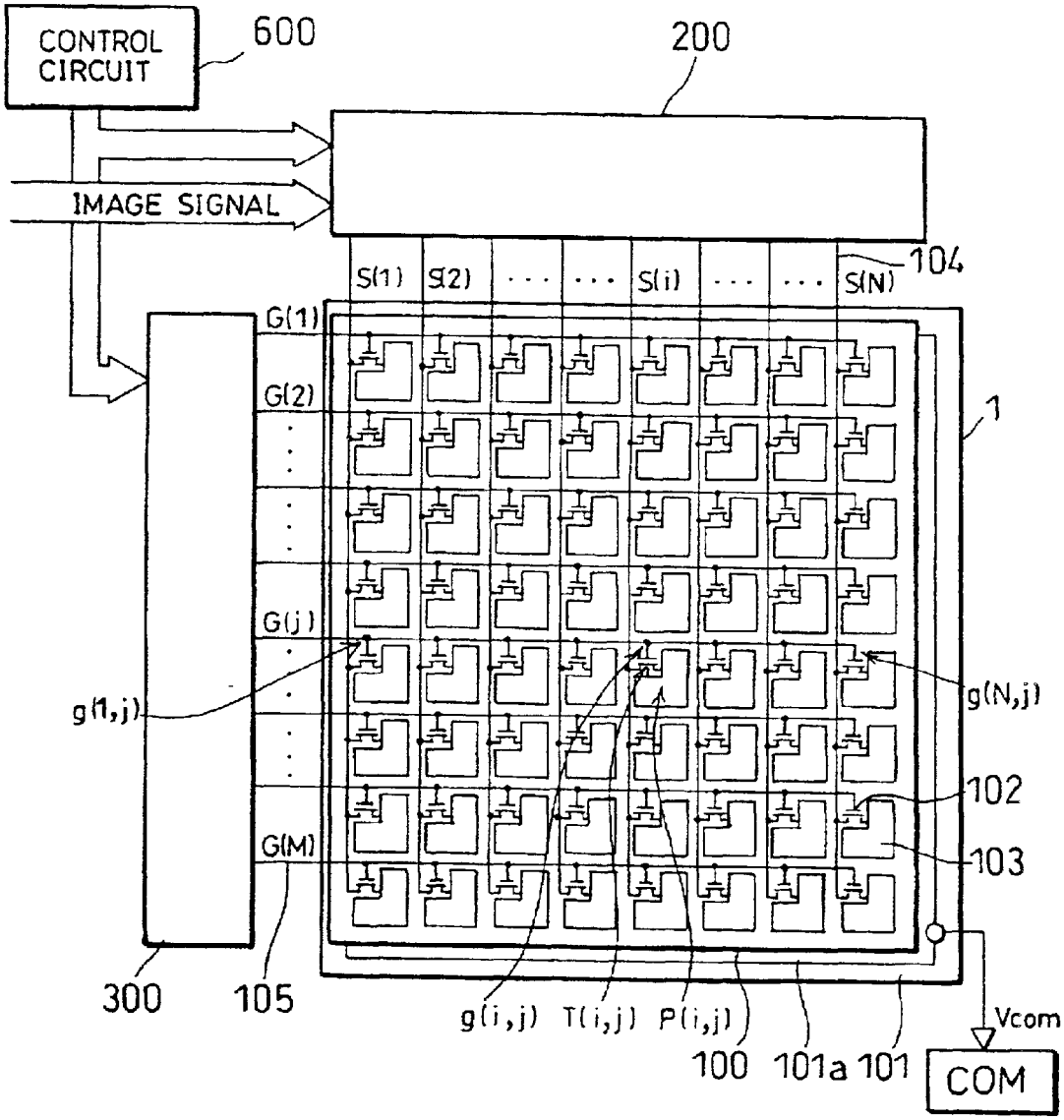
FIG. 9 is an explanatory view illustrating an arrangement of a conventional liquid crystal display device.

FIG. 7 illustrates main components of a scanning signal line driving circuit in accordance with the present embodiment, and FIG. 8 illustrates waveforms of the main components. A signal Stc shown in FIG. 7 is a slope time control signal (charge control signal, and discharge control signal), and controls opening/closing of a switch SW3 which is connected with a capacitor Cct in parallel. A constant currency source Ict is connected with an end of the capacitor Cct via a resistor Rct, and the other end of the capacitor Cct is grounded. A voltage Vct outputted from the capacitor Cct (potential difference between the both ends of the capacitor Cct) is sent to an inverting input terminal of an operational amplifier OP via a resistor R3. A resistor R4 is connected between the inverting input terminal and an output terminal of the operational amplifier OP.

The signal Stc is arranged so as to synchronize with the clock signal (GCK) as shown in FIG. 5, and it may be produced by using a mono multivibrator (not shown) The switch SW3 is closed while the signal Stc is at the high level, and is opened while the signal Stc is at the low level.

On the other hand, a non-inverting input terminal of the operational amplifier OP is connected with an end of a resistor R2 and an end of a resistor R1. The other end of the resistor R2 is grounded, and a signal voltage Vdd is applied to the other end of the resistor R1. The signal voltage Vdd is a direct current voltage at a voltage level Vgh which is enough to cause the TFT to attain an ON state. An output signal VD1*b* as a scanning signal is sent from an output terminal of the operational amplifier OP to an input terminal VD1 of the scanning signal line driving circuit 300 shown in FIG. 10.

The operational amplifier OP and the resistors R1, R2, R3, and R4 constitute a differential amplifying circuit as a subtracting section. In the subtracting section, the following subtraction is conducted:

$$VD1b=Vdd\cdot(R2/(R1+R2))\cdot(1+(R4/R3))-(R4/R3)\cdot Vct$$

Here, let resistances of the resistors R1, R2, R3, and R4 satisfy R1=R4, R2=R3, and A=R4/R3, and the following is satisfied:

$$VD1b=Vdd-A\cdot Vct$$

The following description will explain the operation of the circuit shown in FIG. 7, while referring to FIG. 8.

While the signal Stc outputted from a control section (not shown) is at the low level, the switch SW3 is opened. In this state, power is supplied from the constant currency source Ict through the resistor Rct to the capacitor Cct, where electric charge is stored, and the voltage Vct has a serrature-like waveform as shown in FIG. 8. In the subtracting section, the voltage Vct multiplied by A (=R4/R3) is subtracted from the signal voltage Vdd, and a resultant voltage is outputted as an output signal VD1*b* (falling from the level Vgh by a slope quantity Vslope). Therefore, by varying A, it is possible to cause the output signal VD1*b* to fall by a desirable slope quantity Vslope.

On the other hand, while the signal Stc is at the high level, the switch SW3 is closed. Therefore, the electric charge stored in the capacitor Cct is discharged through the switch SW3, and the voltage outputted from the capacitor Cct becomes zero as shown in FIG. 8. The subtracting section subtracts the voltage Vct multiplied by A (=R4/R3) from the signal voltage Vdd, but since the voltage Vct is zero, the signal voltage Vdd is outputted as the output signal VD1*b* as shown in FIG. 8.

As described above, with the control of the signal Stc, the voltage Vct has a serrature-like waveform with a maximum amplitude Vcth, and the output signal VD1*b* has a waveform with a slope time Tslope and a slope quantity Vslope. The slope quantity Vslope satisfies:

$$Vslope=Vcth\cdot(R4/R3)$$

Therefore, the slope quantity can be easily adjusted by appropriately setting resistances of the resistors R3 and R4. In addition, since the output signal VD1*b* is an output of the operational amplifier OP, the impedance lowers (impedance when the operational amplifier is viewed from the next stage lowers).

By applying the present embodiment, therefore, it is possible to produce a scanning signal-use slope waveform with a fall characteristic optimal to any one of various LCD devices.

As to the display device of the present embodiment, for the same reason as that in the case of the display device of the third embodiment, there is no need to slope the waveform of each fall of the scanning signal thoroughly from the level Vgh to the level Vgl. Therefore, a minimum value of the output signal DV1*b* is not necessarily lower than the threshold value of the TFT.

Incidentally, in the second through fourth embodiments, it is preferable that the falls are controlled on the basis of the signal delay transmission characteristic inherent in the scanning signal line, so that the change rates of the falls are equal wherever on the scanning signal line, as explained in the description of the first embodiment. Further, instead of controlling the falls on the basis of the signal delay transmission characteristic, the slopes of falls of the scanning signal may be controlled on the basis of the gate voltage-drain currency characteristic of the TFT. Furthermore, it is more preferable to control the slopes of falls of the scanning signal based on both the signal delay transmission characteristic and the gate voltage-drain currency characteristic of the TFT.

As has been described above, the display device of the present invention is arranged so as to comprise (1) scanning signal lines, (2) TFTs each having a gate electrode connected with each scanning signal line, (3) image signal lines each of which is connected with a source electrode of each TFT, and (4) pixels each of which has (i) a pixel electrode connected with a drain electrode of the TFT, (ii) a supplemental capacitor element formed between the pixel electrode and the scanning signal line, and (iii) a liquid crystal capacitor element formed between the drain electrode and the counter electrode, and the display device is arranged so that transition from a scanning level to a non-scanning level of a write pulse on the scanning signal line has a certain slope and is gradual. In this case, the transition of the write pulse from the scanning level to the non-scanning level is desirably sloped by considering signal delay transmission characteristics of the scanning signal line.

In the foregoing display device, it is preferable that the transition of the write pulse from the scanning level to the non-scanning level has a desired gradual slope obtained by considering V-I characteristics of the TFTs.

Furthermore, in the foregoing arrangement, it is preferable that the transition of the write pulse from the scanning level to the non-scanning level has a gradual slope obtained by considering both the signal delay transmission characteristics of the scanning signal line and the V-I characteristics of the TFTs.

Another display device of the present invention is arranged so as to comprise (1) a plurality of pixel electrodes, (2) image signal lines for supplying data signals to the corresponding pixel electrodes respectively, (3) scanning signal lines which intersect the image signal lines, and (4) switching elements each of which is provided at each intersection of the image signal lines and the scanning signal lines, so that data signals are supplied to the pixel electrodes, respectively according to a scanning signal for controlling the switching elements, which is supplied to the scanning signal lines, and further, the display device is arranged so that transition from a scanning level to a non-scanning level on the scanning signal has a certain slope and is gradual.

Signal transmission paths from the scanning signal line driving circuit to the plurality of the switching elements preferably have signal delay transmission characteristics. It is preferable that the plurality of the switching elements do not have such switching characteristics as completely binary ON/OFF characteristics, but that an intermediate conductive state is exhibited.

Furthermore, still another display device of the present invention is arranged so as to comprise (1) a plurality of pixel electrodes, (2) image signal lines for supplying data signal to the corresponding pixel electrodes respectively, (3) scanning signal lines which intersect the image signal lines, (4) a scanning signal line driving circuit for driving the scanning signal lines, (5) TFTs each of which is provided at each intersection of the image signal lines and the scanning signal lines, and the display device is arranged so that the scanning signal line driving circuit which is capable of desirably adjusting a speed of output state transition of the scanning signal.

In this case, the speed of level changes of the scanning signal is preferably set by considering the signal delay transition characteristics of the scanning signal line. It is more preferable that the speed of level changes of the scanning signal is set by considering both the signal delay transmission characteristics of the scanning signal lines and the V-I characteristics of the TFTs.

Still another display device of the present invention is arranged so as to comprise (1) a plurality of pixel electrodes, (2) image signal lines for supplying data signal to the corresponding pixel electrodes respectively, (3) scanning signal lines which intersect the image signal lines, (4) a scanning signal line driving circuit for driving the scanning signal lines, (5) TFTs each of which is provided at each intersection of the image signal lines and the scanning signal lines, and the display device is arranged so that the voltage inputted to the scanning signal line driving circuit has a serrature-like waveform.

In this case, the voltage supplied to the scanning signal line driving circuit preferably has a intermittent-serrature-like waveform. A slope of the voltage of the serrature-like waveform is preferably set by considering the signal delay transmission characteristics of the scanning signal line. The slope of the voltage of the serrature-like waveform is preferably set by considering the V-I characteristics of the TFTs, and is more preferably set by considering both the signal delay transmission characteristics of the scanning signal lines and the V-I characteristics of the TFTs.

With the above-described present invention, regarding the fall waveforms of the scanning signal from the scanning signal line driving circuit, influences thereto of a scanning line to which the scanning signal is supplied are apparently smaller and speeds of the falls at respective positions of the scanning line are made uniform. This ensures that level shifts $\Delta Vd$ occurring to the pixel potentials Vd due to parasitic capacitances Cgd are made uniform throughout the display plane.

Furthermore, since the fall waveforms of the scanning signal are dull, linear ON region characteristics of the TFTs are efficiently utilized, whereby the level shifts $\Delta Vd$ occurring to the pixel potentials Vd due to parasitic capacitances Cgd per se are made smaller. As a result, the level shifts parasitically occurring to the pixel electrodes are made uniform and smaller throughout the display plane, and occurrence of flickering of images and occurrence of burn-in residual images can be sufficiently reduced, whereby high-definition and high-performance display devices can be obtained.

As described above, since the present invention ensures that the level shifts caused to pixel potentials by parasitic capacitances which are formed due to the structure are made uniform throughout the display plane, and/or that the level shifts per se are made smaller, it is possible to realize a display device which does not undergo flickering of images and defects such as burn-in residual images and which consumes less power. In other words, it is possible to realize a display device and a display method whose display performance and reliability are further improved. Thus, effects achieved by the present invention are remarkably significant.

Incidentally, as alternating current drive applicable to an LCD device, there have been proposed various schemes including the frame inversion drive in which a polarity of a signal line is switched every frame, the line inversion drive in which the polarity is switched every horizontal signal, and the dot inversion drive in which the polarity is switched every pixel. The present invention, however, does not depend on any one of these such driving schemes, but is effective for any driving scheme. (is efficiently applicable to not only these driving scheme but also any other driving scheme.

Furthermore, the display device of the present invention may be arranged so that the foregoing driving circuit controls the scanning signal based on the signal delay transmission characteristics inherent in the scanning signal lines, so that the scanning signal falls at a substantially same slope wherever on the scanning signal line.

With the foregoing invention, falls of the scanning signal are controlled by the driving circuit on the basis of the signal delay transmission characteristics of the scanning signal line. As a result of the control, the scanning signal falls at a substantially same slope wherever on the scanning signal line.

In the case where the scanning signal abruptly falls as in the conventional cases, the slope of the fall varies depending on positions on the scanning signal line because of the signal delay transmission characteristics inherent in the scanning signal lines. A level shift of a pixel potential in the vicinity of an input-side end of the scanning signal line at which the scanning signal abruptly falls is great, whereas a level shift of a pixel potential in the vicinity of the other end of the scanning signal line at which the scanning signal dully falls is small. Thus, generally the level shifts of pixel potentials are not uniform on the scanning signal line (in the display plane). The non-uniformity of the level shifts are not negligible in the case where the display device has a larger screen and in the case where high definition of images is required.

With the foregoing invention, however, it is possible to make slopes of falls of the scanning signal substantially uniform irrelevant to positions thereof on the scanning signal line. Therefore, the signal delay transmission characteristics inherent in the scanning signal lines can be neglected, and biased distribution of level shifts in the display plane does not occur. Thus, level shifts of the pixel potentials are made substantially uniform.

The display device of the present invention may be arranged so that the driving circuit controls the slopes of the falls of the scanning signal, based on gate voltage-drain currency characteristics of the TFTs.

With the foregoing invention, the slopes of falls of the scanning signal are controlled by the driving circuit on the basis of the voltage-currency characteristics of the TFTs.

Incidentally, the TFT attains transition to the ON state upon application of a threshold voltage to a gate thereof, and maintains the ON state stably upon application of a predetermined ON voltage which is higher than the threshold voltage, while attains transition to the OFF state when the gate voltage lowers to become not higher than the threshold voltage. Besides, when a voltage in a range of the threshold voltage to the ON voltage is applied to the gate, a drain currency (ON resistance) of the TFT linearly varies depending on the gate voltage (in other words, the TFT attains not the ON state out of the binary states, but an intermediate ON state (the drain currency varies in an analog form with the gate voltage)).

In the case where the falls of the scanning signal are abrupt as in the conventional cases, level shifts caused by parasitic capacitances occur to the pixel potentials as described above, irrelevant to the gate voltage-drain currency characteristics of the TFT.

With the foregoing invention, however, it is possible to control the slopes of falls of the scanning signal so that the slopes are influenced by the region of linear change of the TFT. By such control, the falls of the scanning signal slope, while the transition of the TFT from the ON state to the OFF state becomes linear transition on the basis of the voltage-currency characteristics. Therefore, the level shifts caused to the pixel potentials by parasitic capacitances are surely reduced.

As described above, at an initial stage of a fall of the scanning signal, the TFT is not yet in the OFF state but is in an intermediate ON state, in which a signal supplied from a source can be transmitted to the pixel electrode through the TFT and no level shift occurs to the pixel potential. Only at a latter stage of the fall of the scanning signal, a level shift occurs to the pixel potential, but the quantity thereof is small.

The display device of the present invention may be arranged so that the driving circuit controls slopes of falls of the scanning signal on the basis of both the signal delay transmission characteristics inherent in the scanning signal lines and the gate voltage-drain currency characteristics of the TFTs.

With the foregoing invention, it is possible to control the slopes of falls of the scanning signal, depending on the signal delay transmission characteristics inherent in the scanning signal lines and the linear region of the TFT. By such control, the falls of the scanning signal are sloped and transition of the TFT from the ON state to the OFF state becomes linear transition on the basis of the aforementioned voltage-currency characteristics. In result, level shifts caused by parasitic capacitances to the pixel potentials are surely reduced.

In other words, by the present invention, since the scanning signal is made to fall at a substantially same slope wherever on the scanning signal line, the level shifts of the pixel potentials become substantially uniform, while each level shift becomes smaller.

As described above, the level shifts of the pixel potentials occur only in association with a latter stage of each fall of the scanning signal, but each level shift is small and level shift distribution does not occur throughout the display plane.

The display device of the present invention may be further arranged so that the scanning signal is composed of a gate-on voltage which causes the TFT to attain an ON state and a gate-off voltage which causes the TFT to attain an OFF state, and that the driving circuit includes (1) a shift register section composed of a plurality of flip-flops which are cascaded and to which a scanning timing control signal is supplied, (2) slope control sections for controlling the slopes of the falls from the gate-on voltage to the gate-off voltage, and (3) switch sections each of which switches the gate-on voltage for the gate-off voltage or vice versa according to an output of each flip-flop.

According to the foregoing invention, when a scanning timing control signal is supplied to the shift register, a signal for switching signals is outputted from each flip-flop in response to a predetermined clock signal. The switch sections switch the gate-on voltage for the gate-off voltage or vice versa according to the signal outputted by each flip-flop and output the voltage, and here, the gate-off voltage is outputted from the switch sections after its fall is controlled by the slope control sections. Thus, by the foregoing invention, only by adding the slope control sections to the conventional driving circuit (gate driver), the slopes of the falls of the gate-off voltage are controlled on the basis of the signal delay transmission characteristics and/or the gate voltage-drain currency characteristics of the TFTs.

The display device of the present invention may be further arranged so that the scanning signal is composed of a gate-on voltage which causes the TFT to attain an ON state and a gate-off voltage which causes the TFT to attain an OFF state, and that the driving circuit includes (1) a control section for outputting a discharge control signal which synchronizes with each scanning period, and (2) a driving voltage generating section which usually generates the gate-on voltage, and discharges the gate-on voltage in response to the discharge control signal.

According to the foregoing invention, the gate-on voltage is generated and controlled in the following manner. The discharge control signal which synchronizes with each scanning period is sent to the driving voltage generating section by the control section. Normally (in the case where the discharge control signal is non-active), the gate-on voltage is generated. When the gate-on voltage is applied to the scanning signal line, the TFT attains an ON state.

On the other hand, in response to the discharge control signal, the driving voltage generating section discharges the gate-on voltage during the period while the discharge control signal is received. With the discharge, the gate-on voltage lowers.

By thus controlling the timing and quantity of discharge during each scanning period, it is possible to output the scanning signal with a desirable fall slope.

The display device of the present invention may be further arranged so that the scanning signal is composed of a gate-on voltage which causes the TFT to attain an ON state and a gate-off voltage which causes the TFT to attain an OFF state, and that the driving circuit includes (1) a control section which outputs a charge control signal and a discharge control signal, which both synchronize with each scanning period, (2) a slope voltage control section which charges up in response to the charge control signal and outputs a slope control voltage, while makes the slope control voltage zero by discharging in response to the discharge control signal, and (3) a subtracting section which outputs a voltage resulting on subtraction of the slope control voltage from the gate-on voltage during the charging, while outputs the gate-on voltage during the discharge.

According to the foregoing invention, the gate-on voltage as the scanning signal is produced and controlled in the following manner. The charge control signal and the discharge control signal which synchronizes with each scanning period are outputted by the control section to the slope voltage control section. In response to the discharge control signal, the slope voltage control section suspends the charging operation, and makes the slope control voltage zero by discharging. With the discharge, the gate-on voltage, without being subject to subtraction, is applied from the subtracting section to the scanning signal line, and the TFT attains the ON state.

On the other hand, in response to the charge control signal, the slope voltage control section conducts the charging operation until receiving the discharge control signal, and outputs the slope control voltage to the subtracting section. With the charge, a result of subtraction of the slope control voltage from the gate-on voltage is applied from the subtracting section to the scanning signal line. With this application, the scanning signal becomes smaller than the threshold voltage, and the TFT attains the OFF state.

By thus controlling the timing and quantity of discharge during each scanning period, it is possible to output the scanning signal with a desirable fall slope.

The display method of the present invention, wherein a scanning signal is supplied through scanning signal lines which intersect the image signal lines and actuate the pixel electrodes so as to realize display, is arranged so that during the actuation falls of the scanning signal are controlled.

According to the foregoing invention, the scanning signal is outputted to the scanning signal lines so as to actuate the pixel electrodes, and during this operation, the falls of the scanning signal are controlled.

Generally, parasitic capacitances affect the actuation. In the case where the scanning signal abruptly falls as in the conventional cases, the TFT immediately attains an OFF state, and upon this, a pixel potential lowers by a quantity corresponding to a fall quantity of the scanning signal (a scanning voltage minus a non-scanning voltage) due to the parasitic capacitance, whereby a level shift occurs to the pixel potential. Such level shift occurring to the pixel potential leads to flickering of a displayed image, deterioration of display, and the like.

According to the foregoing display method, however, the falls of the scanning signal are controlled, and hence it is possible to control the scanning signal so that it does not abruptly fall. This ensures that the level shifts of the pixel potentials caused by the parasitic capacitances are reduced.

Furthermore, the display method of the present invention can be arranged so that during the actuation, the scanning signal is controlled on the basis of signal delay transmission characteristics inherent in the scanning signal lines, so that the scanning signal falls at a substantially same slope wherever on the scanning signal lines.

According to the foregoing invention, during the actuation, falls of the scanning signal are controlled on the basis of the signal delay transmission characteristics of the scanning signal lines. As a result of this control, the scanning signal falls at a substantially same slope irrelevant to positions on the scanning signal lines.

Generally, level shifts of pixel potentials are not uniform on the scanning signal lines (on the display plane). Such irregularities in the level shifts are not negligible when the LCD device is required to have a larger screen and to be high-definition.

However, according to the foregoing invention, the slopes of falls of the scanning signal are made uniform irrelevant to positions on the scanning signal lines, whereby the level shifts of the pixel potentials are made substantially uniform.

Furthermore, the display method of the present invention is arranged so that during the actuation, slopes of the falls of the scanning signal are controlled on the basis of gate voltage-drain currency characteristics of a plurality of TFTs provided at the intersections of the image signal lines and the scanning signal lines.

According to the foregoing invention, during the actuation, slopes of falls of the scanning signal are controlled on the basis of the voltage-currency characteristics of the TFTs.

Incidentally, the TFT attains transition to the ON state upon application of a threshold voltage to a gate thereof, and maintains the ON state stably upon application of a predetermined ON voltage which is higher than the threshold voltage, while attains transition to the OFF state when the gate voltage lowers to become not higher than the threshold voltage. Besides, when a voltage in a range of the threshold voltage to the ON voltage is applied to the gate, a drain currency (ON resistance) of the TFT linearly varies depending on the gate voltage (in other words, the TFT attains not the ON state out of the binary states, but an intermediate ON state (the drain currency varies in an analog form with the gate voltage)).

In the case where the falls of the scanning signal are abrupt as in the conventional cases, level shifts caused by parasitic capacitances occur to the pixel potentials as described above, irrelevant to the gate voltage-drain currency characteristics of the TFT.

With the foregoing invention, however, it is possible to control the slopes of falls of the scanning signal so that the slopes are influenced by the region of linear change of the TFT. By such control, the falls of the scanning signal slope, while the transition of the TFT from the ON state to the OFF state becomes linear transition on the basis of the voltage-currency characteristics. Therefore, the level shifts caused to the pixel potentials by parasitic capacitances are surely reduced.

Furthermore, the display method of the present invention can be arranged so that during the actuation, slopes of the falls of the scanning signal are controlled on the basis of both the signal delay transmission characteristics inherent in the scanning signal lines and the gate voltage-drain currency characteristics of a plurality of TFTs provided at the intersections of the image signal lines and the scanning signal lines.

With the foregoing arrangement, it is possible to control the slopes of falls of the scanning signal, depending on the signal delay transmission characteristics inherent in the scanning signal line and the linear region of the TFT. By such control, the falls of the scanning signal are sloped and transition of the TFT from the ON state to the OFF state becomes linear transition on the basis of the aforementioned voltage-currency characteristics. In result, level shifts caused by parasitic capacitances to the pixel potentials are surely reduced.

In other words, by the present invention, since the scanning signal is made to fall at a substantially same slope wherever on the scanning signal line, the level shifts of the pixel potentials become substantially uniform, while each level shift becomes smaller.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A display device, comprising:

a plurality of pixel electrodes;

image signal lines for supplying data signals to said pixel electrodes;

a plurality of scanning signal lines provided so as to intersect said image signal lines;

a driving circuit for outputting a scanning signal to actuate said scanning signal lines;

thin film transistors each having a gate, a source, and a drain which are connected with one scanning signal line, one image signal line, and one image electrode, respectively, said thin film transistors being provided at the intersections of said image signal lines and said scanning signal lines, respectively;

wherein said driving circuit controls falls of the scanning signal;

wherein the scanning signal is composed of a gate-on voltage which causes said thin film transistor to attain an ON state and a gate-off voltage which causes said thin film transistor to attain an OFF state; and wherein said driving circuit includes:

a shift register section composed of a plurality of flip-flops which are cascaded and to which a scanning timing control signal is supplied;

slope control sections for controlling the slopes of the falls from the gate-on voltage to the gate-off voltage, where each slope control section includes a slew-rate control element; and switch sections each of which switches the gate-on voltage for the gate-off voltage or vice versa according to an output of each flip-flop.

2. A display device, comprising:

a plurality of pixel electrodes;

image signal lines for supplying data signals to said pixel electrodes;

a plurality of scanning signal lines provided so as to intersect said image signal lines;

a driving circuit for outputting a scanning signal to actuate said scanning signal lines;

thin film transistors each having a gate, a source, and a drain which are connected with one scanning signal line, one image signal line, and one image electrode, respectively, said thin film transistors being provided at the intersections of said image signal lines and said scanning signal lines, respectively, wherein said driving circuit controls falls of the scanning signal;

wherein the scanning signal is composed of a gate-on voltage which causes said thin film transistor to attain an ON state and a gate-off voltage which causes said thin film transistor to attain an OFF state; and wherein said driving circuit includes:

a control section which outputs a charge control signal and a discharge control signal, which both synchronize with each scanning period;

a slope voltage control section which charges up in response to the charge control signal and outputs a slope control voltage, while makes the slope control voltage zero by discharging in response to the discharge control signal; and a subtracting section which outputs a voltage resulting on subtraction of the slope control voltage from the gate-on voltage during the charging, while outputs the gate-on voltage during the discharge.

3. The display device as set forth in claim 2, wherein the voltage outputted from said subtracting section has a serrature-like waveform.

4. The display device as set forth in claim 2, wherein a minimum value of the voltage outputted from said subtracting section is substantially equal to a threshold voltage of said thin film transistors.

5. The display device as set forth in claim 2, wherein said subtracting section is composed of a differential amplifying circuit including an operational amplifier.

6. A display device, comprising:

a plurality of pixel electrodes;

image signal lines for supplying data signals to said pixel electrodes;

a plurality of scanning signal lines provided so as to intersect said image signal lines;

a driving circuit for outputting a scanning signal to actuate said scanning signal lines;

thin film transistors each having a gate, a source, and a drain which are connected to one scanning signal line, one image signal line, and one pixel electrode, respectively, said thin film transistors being provided at the intersections of said image signal lines and said scanning signal lines, respectively; and wherein said driving circuit is adapted so as to control a waveform of the scanning signal so that the scanning signal falls at a predetermined slope, where the predetermined slope is established based on one of setting a change rate of the fall of the waveform in a vicinity of an input-side end of the scanning signal line so as to be substantially equal to a change rate of the fall of the waveform in a vicinity of the other end of the scanning signal line, a basis of signal delay transmission characteristics, a basis of a gate-voltage drain currency characteristic of pixel switching elements.

7. The display device as set forth in claim 6, wherein the scanning signal falls forming the slope in the waveform all the way from a HIGH to a LOW.

8. The display device as set forth in claim 6, wherein the scanning signal falls forming the slope in the waveform part of the way from a HIGH to a LOW.

9. The display device as set forth in claim 8, wherein the slope appears in the waveform in an area where said thin film transistors are on.

10. A display method of carrying out display comprising the steps of:

supplying data signals to a plurality of pixel electrodes through image signal lines, actuating the pixel electrodes by supplying a scanning signal to scanning signal lines which intersect the image signal lines, wherein during the actuation, control is carried out so that the scanning signal has a waveform falling at a predetermined slope; and establishing the predetermined slope by causing a change rate of the fall of the waveform in a vicinity of an input-side end of a given scanning signal line to be substantially equal to a change rate of the fall of the waveform in a vicinity of the other end of the scanning signal line, based on (a) a basis of signal delay transmission characteristics and/or (b) a basis of a gate-voltage drain currency characteristic of pixel switching elements.

11. The display method as set forth in claim 10, wherein during the actuation, control is carried out so that the scanning signal falls forming the slope in the waveform all the way from a HIGH to a LOW.

12. The display method as set forth in claim 10, wherein during the actuation, control is carried out so that the scanning signal falls forming the slope in the waveform part of the way from a HIGH to a LOW.

13. The display method as set forth in claim 12, wherein during the actuation, control is carried out so that the slope appears in the waveform in an area where a plurality of thin film transistors provided at respective intersections of the image signal lines and the scanning signal lines are on.

14. A display device, comprising:

a plurality of pixel electrodes;

image signal lines for supplying data signals to said pixel electrodes;

a plurality of scanning signal lines provided so as to intersect said image signal lines;

a driving circuit for outputting a scanning signal to actuate said scanning signal lines;

thin film transistors each having a gate, a source, and a drain which are connected with one scanning signal line, one image signal line, and one pixel electrode, respectively, said thin film transistors being provided at the intersections of said image signal lines and said scanning signal lines, respectively;

wherein said driving circuit controls falls of the scanning signal;

wherein said driving circuit controls the slopes of the falls of the scanning signal, based on gate voltage-drain currency characteristics of said thin film transistors, and based on a signal transmission delay characteristic.

15. A display method of carrying out display comprising:

supplying data signals to a plurality of pixel electrodes through image signal lines and actuating the pixel electrodes by supplying a scanning signal through scanning lines which intersect the image signal lines, wherein during the actuation, slopes of the falls of the scanning signal are controlled on the basis of gate voltage-drain currency characteristics of a plurality of thin film transistors provided at the intersections of the image signal lines and the scanning signal lines; and wherein during the actuation, said driving circuit controls the slopes of the falls of the scanning signal, based on gate voltage-drain currency characteristics of said thin film transistors, and based on a signal transmission delay characteristic.

16. A display device, comprising:

a plurality of pixel electrodes;

image signal lines for supplying data signals to said pixel electrodes;

a plurality of scanning signal lines provided so as to intersect said image signal lines;

a driving circuit for outputting a scanning signal to actuate said scanning signal lines;

thin film transistors each having a gate, a source, and a drain which are connected with one scanning signal line, one image signal line, and one pixel electrode, respectively, said thin film transistors being provided at the intersections of said image signal lines and said scanning signal lines, respectively;

wherein said driving circuit controls falls of the scanning signal; and wherein said driving circuit controls the slopes of the falls of the scanning signal, based on gate voltage-drain currency characteristics of said thin film transistors and so a change rate of the fall of the waveform in a vicinity of an input-side end of the scanning signal line is substantially equal to a change rate of the fall of the waveform in a vicinity of the other end of the scanning signal line.

* * * * *